US009242766B2

(12) United States Patent
Ruddell et al.

(10) Patent No.: US 9,242,766 B2
(45) Date of Patent: Jan. 26, 2016

(54) BAG CLAMP WITH A RECIPROCATING BLADE

(71) Applicants: Gregory Roy Ruddell, Aldergrove, CA (US); Robert J. Halas, Surrey, CA (US)

(72) Inventors: Gregory Roy Ruddell, Aldergrove, CA (US); Robert J. Halas, Surrey, CA (US)

( * ) Notice: Subject to any disclaimer, the term of this patent is extended or adjusted under 35 U.S.C. 154(b) by 0 days.

(21) Appl. No.: 14/403,120

(22) PCT Filed: May 21, 2013

(86) PCT No.: PCT/CA2013/050388
§ 371 (c)(1),
(2) Date: Nov. 21, 2014

(87) PCT Pub. No.: WO2013/173919
PCT Pub. Date: Nov. 28, 2013

(65) Prior Publication Data

US 2015/0101284 A1 Apr. 16, 2015

Related U.S. Application Data

(63) Continuation-in-part of application No. 13/476,733, filed on May 21, 2012.

(60) Provisional application No. 61/719,461, filed on Oct. 28, 2012.

(51) Int. Cl.
*B26B 11/00* (2006.01)
*B65D 33/16* (2006.01)
(Continued)

(52) U.S. Cl.
CPC ..... *B65D 33/1675* (2013.01); *B65B 69/0033* (2013.01); *B65D 33/00* (2013.01); *Y10T 24/15* (2015.01)

(58) Field of Classification Search
CPC .... B65D 33/1675; B65D 33/16; B65D 33/00; B65D 33/06; B65D 33/1616; B65D 33/25
USPC ..... 7/158, 156; 30/123, 280, 283, 294; 24/30.5 R, 30.5 S, 30.5 L, 501, 502, 505
See application file for complete search history.

(56) References Cited

U.S. PATENT DOCUMENTS 1,895,754 A 1/1933 Finkenwirth
2,420,460 A * 5/1947 Bowdoin et al. ..... 83/614
(Continued)

FOREIGN PATENT DOCUMENTS

DE 9104600 6/1991
DE 102004018589 11/2005
(Continued)

OTHER PUBLICATIONS

WIPO, International Searching Authority, International Search Report mailed Oct. 3, 2013 in International Patent Application No. PCT/CA2013/050388, 5 pages.
(Continued)

*Primary Examiner* — Monica Carter
*Assistant Examiner* — Melanie Alexander
(74) *Attorney, Agent, or Firm* — Cameron IP

(57) ABSTRACT

An improved bag clamp comprises a first jaw member and a second jaw member. The first jaw member has an opening in a clamping surface thereof and there is a blade reciprocatingly movable along the second jaw member. A hinge couples the first jaw member and the second jaw member. The clamp is moveable between an open configuration in which the first jaw member and second jaw member are angularly spaced and a closed configuration in which the blade is received by the opening in the first jaw member and the blade is moveable along the second jaw member.

4 Claims, 13 Drawing Sheets

(51) Int. Cl.
*B65B 69/00* (2006.01)
*B65D 33/00* (2006.01)

(56) References Cited

U.S. PATENT DOCUMENTS

| | | | | | |
|---|---|---|---|---|---|
| 2,585,421 | A | | 2/1952 | Armand | |
| 2,679,098 | A | | 5/1954 | Deicken | |
| 3,774,251 | A | | 11/1973 | Pellman | |
| 4,296,529 | A | | 10/1981 | Brown | |
| 4,580,342 | A | | 4/1986 | Beuzart | |
| 4,716,886 | A | | 1/1988 | Schulman et al. | |
| D299,008 | S | | 12/1988 | Naslund | |
| 4,831,734 | A | * | 5/1989 | De Ruyter et al. | 30/124 |
| 4,847,956 | A | | 7/1989 | Levine | |
| 4,887,335 | A | | 12/1989 | Folkmar | |
| 5,014,431 | A | * | 5/1991 | Jebe et al. | 30/124 |
| 5,347,671 | A | * | 9/1994 | Hunts | 7/156 |
| 5,428,871 | A | | 7/1995 | Iosif | |
| D375,045 | S | | 10/1996 | Weber et al. | |
| 5,604,959 | A | | 2/1997 | Bowen | |
| 5,617,616 | A | | 4/1997 | Cutts, Sr. | |
| 5,713,108 | A | | 2/1998 | Solomon et al. | |
| D391,851 | S | | 3/1998 | Joergensen | |
| 5,802,677 | A | | 9/1998 | Dorman et al. | |
| 5,860,215 | A | * | 1/1999 | Roskam et al. | 30/254 |
| 5,979,278 | A | * | 11/1999 | Warthen et al. | 83/20 |
| 5,996,237 | A | * | 12/1999 | Sanders | 33/42 |
| D420,912 | S | | 2/2000 | Vaught | |
| D423,353 | S | | 4/2000 | Blanchard et al. | |
| 6,058,572 | A | | 5/2000 | Folkmar | |
| 6,105,217 | A | | 8/2000 | Caradine et al. | |
| D431,004 | S | | 9/2000 | Naslund | |
| D447,691 | S | | 9/2001 | Messer | |
| 6,363,588 | B1 | | 4/2002 | Caradine | |
| 6,578,243 | B1 | | 6/2003 | Hall | |
| D482,968 | S | | 12/2003 | Henriksson | |
| 6,805,485 | B2 | | 10/2004 | Hogan et al. | |
| 6,904,646 | B2 | | 6/2005 | Reynolds | |
| 7,131,169 | B2 | | 11/2006 | Folkmar | |
| 7,181,806 | B2 | | 2/2007 | Folkmar | |
| 7,284,303 | B2 | | 10/2007 | Canegallo et al. | |
| D566,511 | S | | 4/2008 | Seehoff et al. | |
| RE40,756 | E | | 6/2009 | Hall | |
| D642,913 | S | | 8/2011 | Osborn et al. | |
| 2005/0063616 | A1 | | 3/2005 | Chang | |
| 2005/0120521 | A1 | | 6/2005 | Folkmar | |
| 2011/0119872 | A1 | | 5/2011 | Clearman | |
| 2013/0305540 | A1 | | 11/2013 | Ruddell et al. | |

FOREIGN PATENT DOCUMENTS

| | | |
|---|---|---|
| DE | 202006003686 | 7/2006 |
| WO | 02076836 | 10/2002 |
| WO | 2005012123 | 2/2005 |
| WO | 2014029408 | 2/2014 |

OTHER PUBLICATIONS

WIPO, International Searching Authority, International Search Report mailed Sep. 27, 2013 in International Patent Application No. PCT/CA2013/050389, 4 pages.

WIPO, International Searching Authority, International Search Report mailed Apr. 24, 2013 in International Patent Application No. PCT/EP2012/003588, 4 pages.

WIPO, International Searching Authority, Written Opinion of the International Searching Authority mailed Sep. 27, 2013 in International Patent Application No. PCT/CA2013/050389, 5 pages.

WIPO, International Searching Authority, Written Opinion of the International Searching Authority mailed Oct. 3, 2013 in International Patent Application No. PCT/CA2013/050388, 5 pages.

English Abstract of DE 202006003686 which was published on Jul. 6, 2006 as made available from esp@cenet as of Oct. 6, 2014.

English Abstract of DE 102004018589 which was published on Nov. 10, 2005 as made available from esp@cenet as of Oct. 6, 2014.

* cited by examiner

BAG CLAMP WITH A RECIPROCATING BLADE

BACKGROUND OF THE INVENTION

1. Field of the Invention

The present invention relates to a bag clamp and, in particular, to a bag clamp which may be used to open a sealed bag and releasably reseal the opened bag.

2. Description of the Related Art

It is known to releasably reseal an open-mouthed bag with a clamp. One type of clamp which is commonly used comprises longitudinally extending, elongate jaws which are pivotably connected at first ends thereof and releasably connectable with a locking mechanism at second ends thereof. Examples of such clamps are disclosed in U.S. Pat. No. 4,887,335 and U.S. Pat. No. 6,058,572 both to Folkmar and the full disclosures of which are incorporated herein by reference. In operation, the elongate jaws are pivoted about their first ends to bring the clamp into engagement with the bag. A locking mechanism is then secured to releasably couple second ends of the elongate jaws and thereby seal the bag. The bag may later be accessed by releasing the locking mechanism and pivoting the elongate jaws open to release the bag from the clamp.

SUMMARY OF THE INVENTION

It is an object of the present invention to provide an improved bag clamp which may be used to open a sealed bag and releasably seal or close the opened bag.

There is accordingly provided an improved bag clamp comprising a first jaw member and a second jaw member. The first jaw member has an opening in a clamping surface thereof and the second jaw member has a slot extending therethrough. A hinge couples the first jaw member and the second jaw member. The clamp is moveable between an open configuration in which the first jaw member and second jaw member are angularly spaced-apart and a closed configuration in which the opening in the first jaw member is substantively aligned with the slot in the second jaw member. There is a releasable locking mechanism for locking the clamp in the closed configuration. The first jaw member may be an elongate jaw member and the opening may be a channel extending along a length of the first jaw member. The second jaw member may be an elongate jaw member and the slot may extend along a length of the second jaw member.

There is also provided an improved bag clamp in which a first jaw member has an opening in a clamping surface thereof and a second jaw member has a blade movable along a length thereof. A hinge couples the first jaw member and the second jaw member. The clamp is moveable between an open configuration in which the first jaw member and second jaw member are angularly spaced-apart and a closed configuration in which the opening in the first jaw member is aligned with the blade of the second jaw member. There is a locking mechanism for locking the clamp in the closed configuration. The first jaw member may be an elongate jaw member and the opening may extend along a length of the first jaw member. The second jaw member may be an elongate jaw member and the blade may reciprocate along a length of the second jaw member. The blade may be a pivotable bi-directional cutting blade. The hinge may include a pivot pin provided with an elastomeric bearing.

BRIEF DESCRIPTIONS OF DRAWINGS

The invention will be more readily understood from the following description of the embodiments thereof given, by way of example only, with reference to the accompanying drawings, in which.

DESCRIPTIONS OF THE PREFERRED EMBODIMENTS

Figure 1:
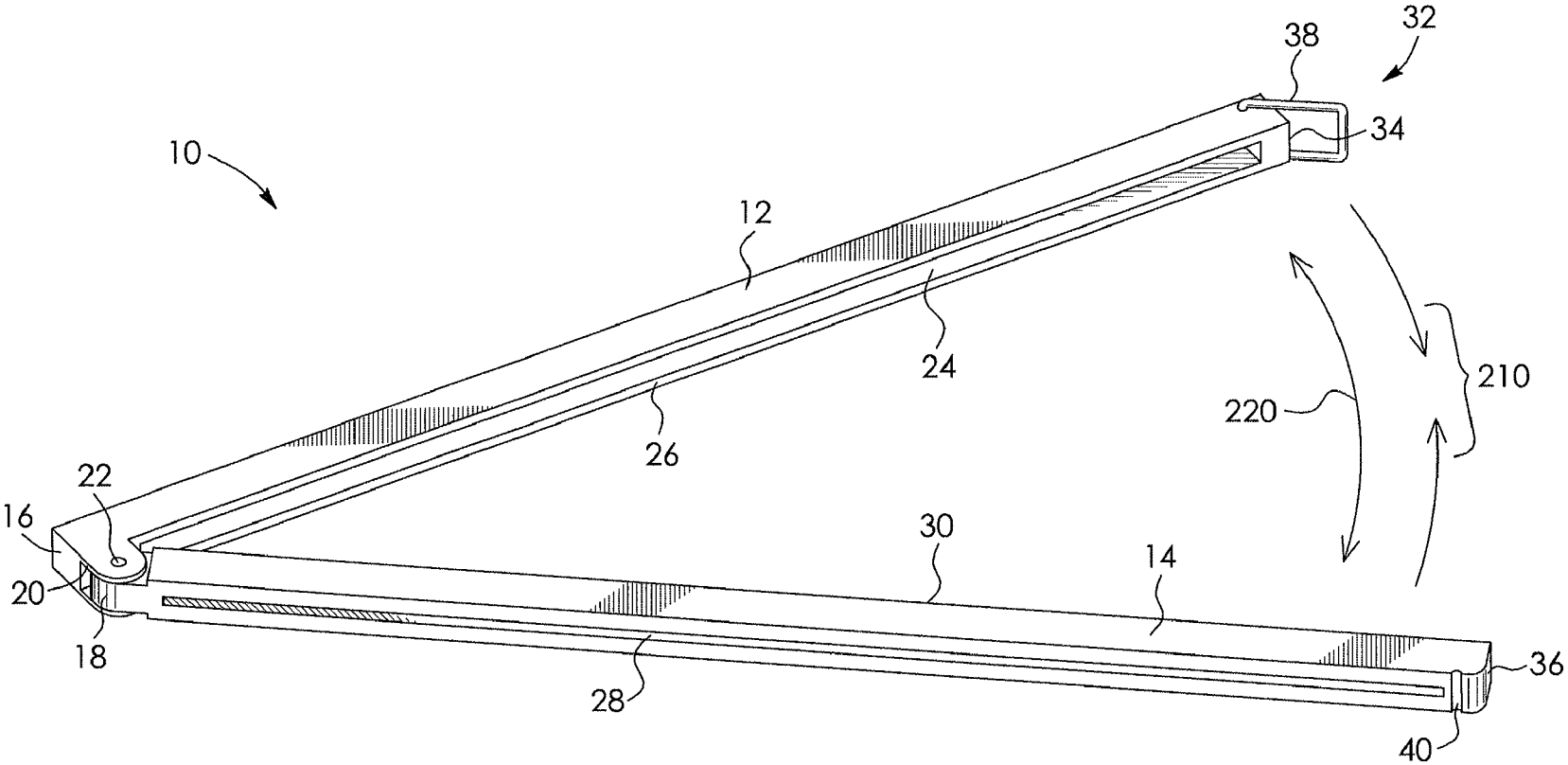
FIG. 1 is a perspective view of a first embodiment of an improved bag clamp showing the clamp in an open configuration.

Referring to the drawings and first to FIG. 1 a first embodiment of an improved bag clamp 10 is shown. The clamp 10 includes a first jaw member 12 and a second jaw member 14 which are pivotably coupled to one another. The jaw members 12 and 14 are both longitudinally extending, elongate jaw members which are pivotably coupled at respective first ends 16 and 18 thereof. In this example, the first jaw member 12 has a clevis 20 which receives the second jaw member 14. There is a clevis pin 22 which extends through the second jaw member 14. The second jaw member 14 is pivotable about the clevis pin 22 which functions as a pivot pin for the second jaw member 14, i.e. the clevis 20 and clevis pin 22 may function as a hinge. The jaw members 12 and 14 are accordingly able to pivot towards one another as indicated generally by arrows 210 and away from one another as indicated generally by arrows 220. An opening in the form of a channel 24 extends along a length of a clamping surface 26 of the first jaw member 12. A slot 28 extends through the second jaw member 14 along a length of a clamping surface 30 of the second jaw member 14.

Figure 2:
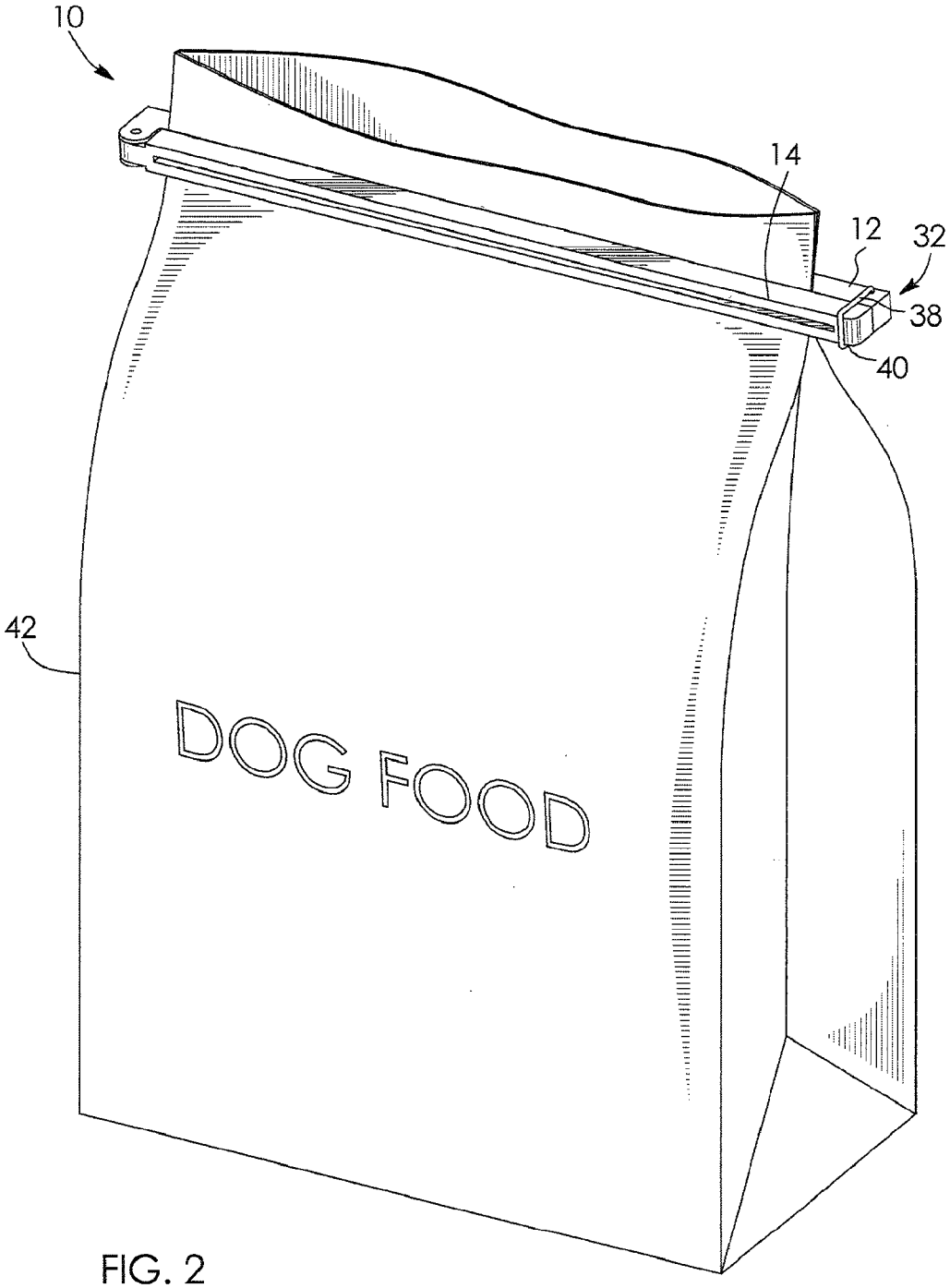
FIG. 2 is a perspective view of the clamp of FIG. 1 showing the clamp in a closed configuration and in engagement with an open-mouthed bag.

There is a locking mechanism 32 which may be used to releasably connect the jaw members 12 and 14 at respective second ends 34 and 36 thereof. In this example, the locking mechanism 32 includes a latch 38 and a groove 40. The latch in this example is a generally U-shaped wire loop. The latch 38 is pivotably mounted on the first jaw member 12 and the groove 40 extends transversely along the second jaw member 14. Referring now to FIG. 2, when the clamp 10 is used to seal or close an open-mouthed bag 42, the locking mechanism 32 is engaged by bringing the latch 38 into engagement with the groove 40. The clamp 10 is thereby clamped to the bag 42 and is maintained in a closed configuration with a portion of the open-mouthed bag 42 being compressed between planar clamping surfaces of the jaw members 12 and 14. The clamp 10 is thereby used to seal the open-mouthed bag. The locking mechanism 32 may however be released, and the jaw members 12 and 14 pivoted away from one another, to release the clamp 10 from the bag 42. This allows access to an interior the bag 42 which may later be resealed, i.e. the clamp 10 may be used to releasably seal or close the bag 42. In the open configuration the jaws 12 and 14 are angularly spaced-apart as shown in FIG. 1.

Figure 3:
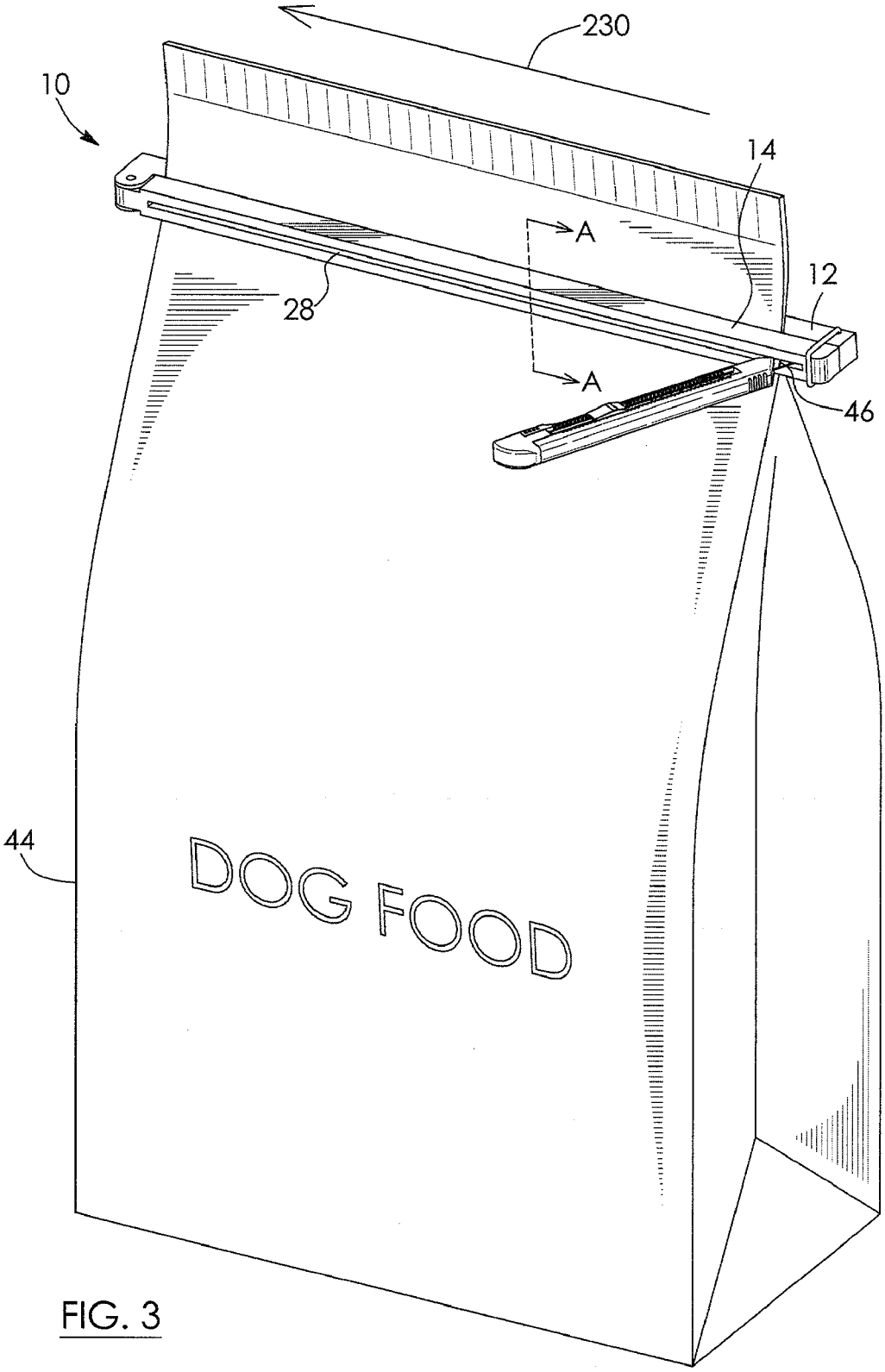
FIG. 3 is a perspective view of the clamp of FIG. 1 showing the clamp in a closed configuration and being used to open a sealed bag.
Figure 4:
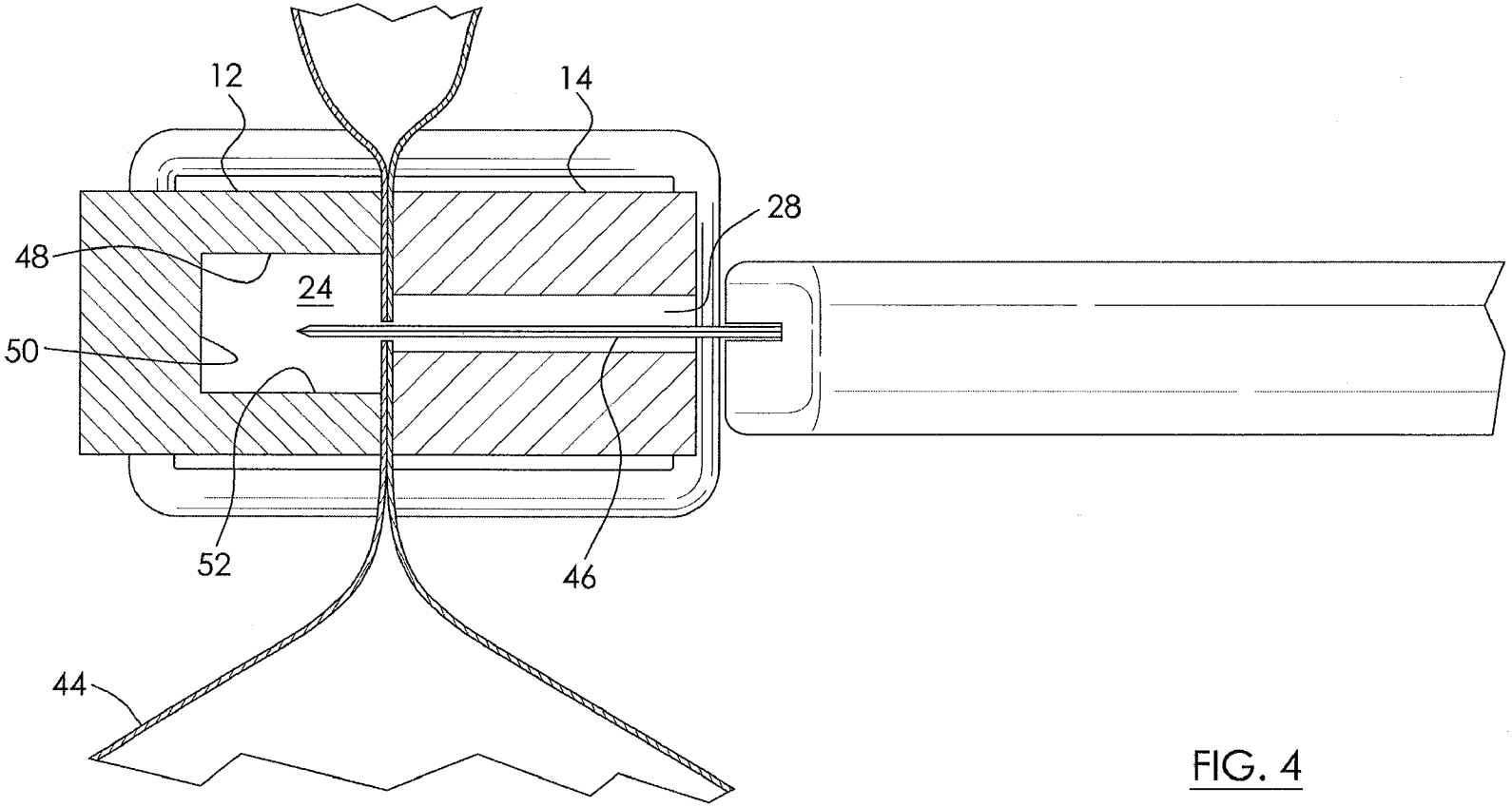
FIG. 4 is a sectional view taken along lines A-A of FIG. 3.

The clamp 10 may also be used to open a sealed bag 44 as shown in FIGS. 3 and 4. The clamp 10 is clamped to the sealed bag 44 as described above and a blade 46, which is this example is a blade on a box cutter, is inserted into one end of the slot 28 in the second jaw member 14. The blade 46 should be inserted with sufficient force to pierce the bag 40 as shown in FIG. 4. Moving the blade 46 along the slot 28 in the direction generally indicated by arrow 230, shown in FIG. 3, should then result in the sealed bag 44 being cut open. The channel 24 in the first jaw member 12 is aligned with the slot 28 in the second jaw member 14 when the clamp 10 is in the closed configuration as shown in FIG. 4. The blade 46 is accordingly received by the channel 24 in the first jaw member 12 and the channel walls 48, 50 and 52 prevent the blade 46 from extending completely through clamp 10. A now open-mouthed bag may later be releasably resealed using the clamp 10 as shown in FIG. 2 and described above.

Figure 5:
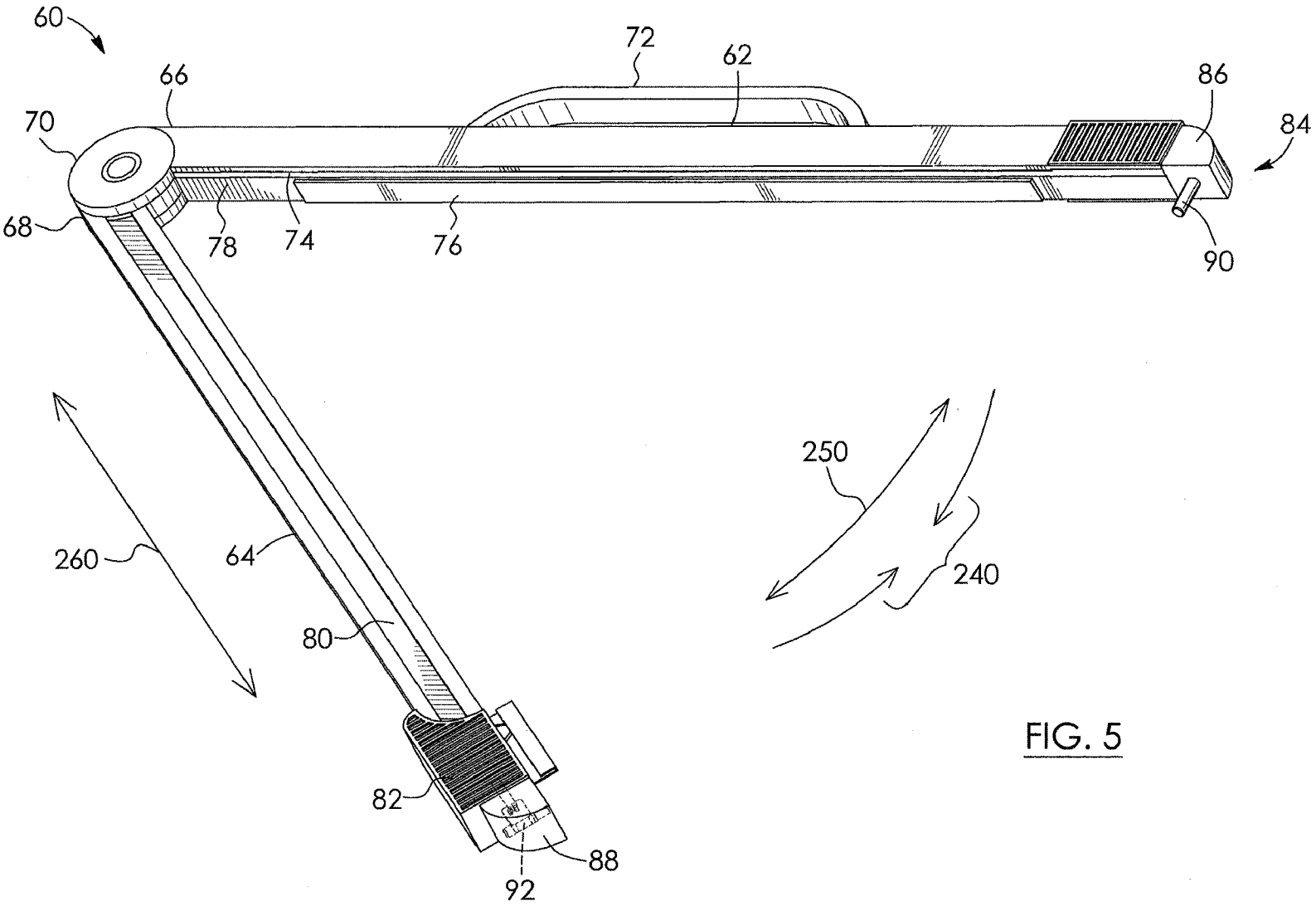
FIG. 5 is a perspective view of a second embodiment of an improved bag clamp showing the clamp in an open configuration.
Figure 6:
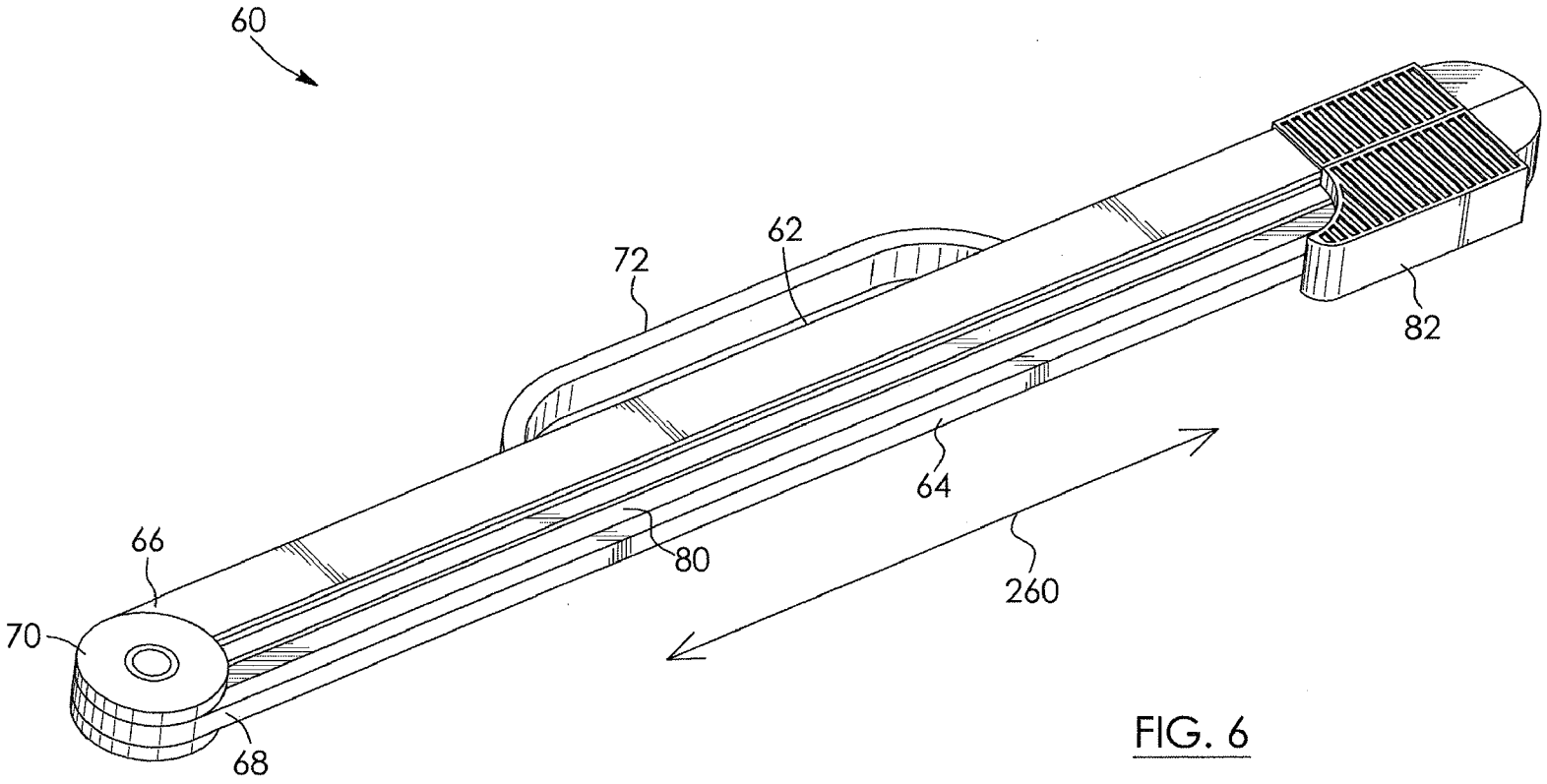
FIG. 6 is a perspective view of the clamp of FIG. 5 showing the clamp in a closed configuration.
Figure 10:
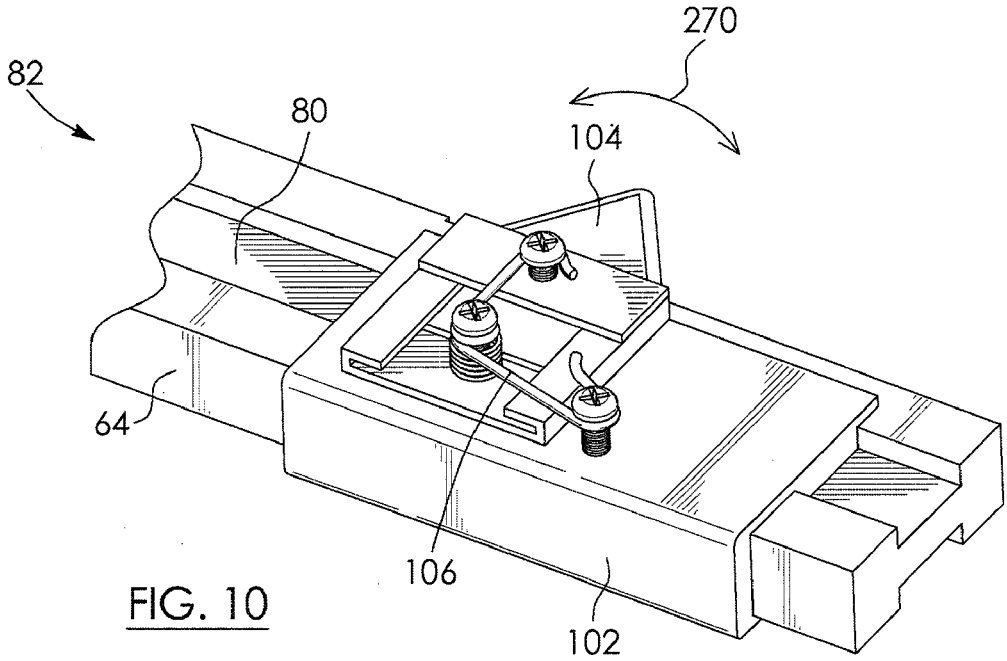
FIG. 10 is a fragmentary, broken-away perspective view of the clamp of FIG. 5 showing a blade and blade mount of a cutting mechanism thereof.

Referring now to FIGS. 5 and 6, a second embodiment of an improved bag clamp 60 is shown. The clamp 60 includes a first jaw member 62 and a second jaw member 64. The jaw members 62 and 64 are longitudinally extending, elongate jaws which are coupled at respective first ends 66 and 68 thereof by a hinge 70. The jaw members 62 and 64 are moveable toward and away from one another in the directions generally indicated by arrows 240 and 250 in FIG. 5. The clamp 60 is accordingly moveable between an open configuration, shown in FIG. 5, and a closed configuration shown in FIG. 6. A handle 72 is mounted on the first jaw member 62. As best shown in FIG. 5, there is also an elongate opening 74 and an elongate pad 76 each extending along a length of a clamping surface 78 of the first jaw member 62. In this example, the pad 76 is a textured rubber pad. There is a grooved track 80 which extends longitudinally along both sides the second jaw member 64 as best shown in FIG. 10. A cutting mechanism 82 is mounted on the track 80 and can reciprocate along the second jaw member 64 in the directions generally indicated by arrow 260. There is also a locking mechanism 84 which may be used to releasably connect the jaw members 62 and 64 at respective second ends thereof 86 and 88. In this example, the locking mechanism includes, in part, a ratchet pin 90 on the first jaw member 62 and a graduated ratcheting clasp 92 disposed in the second jaw member 64.

Figure 7:
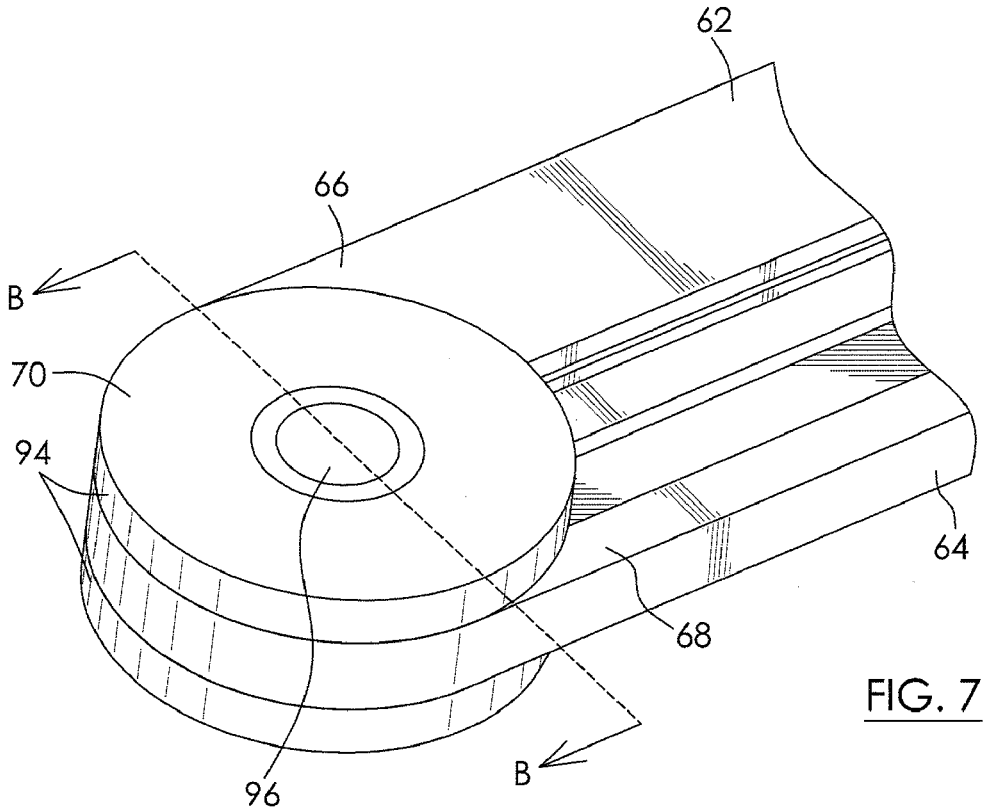
FIG. 7 is a fragmentary, perspective view of the clamp of FIG. 5 showing a hinge and a pivot pin thereof.
Figure 8:
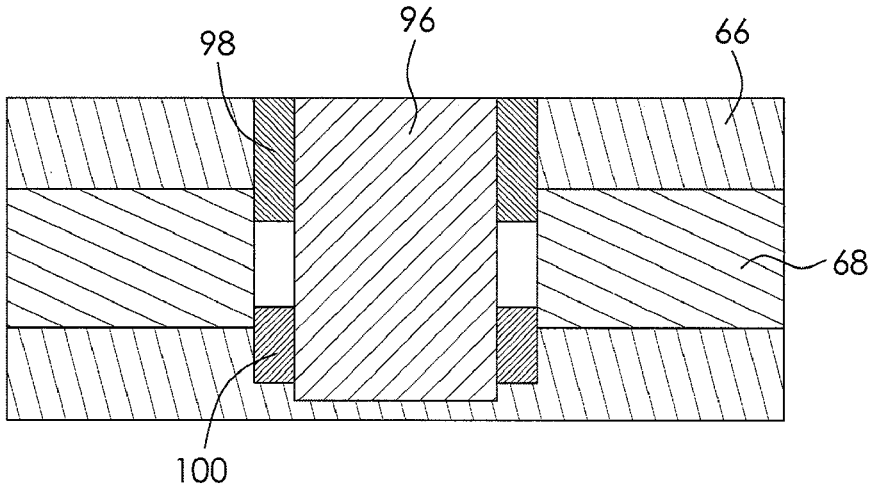
FIG. 8 is a sectional view taken along lines B-B of FIG. 7.
Figure 9:
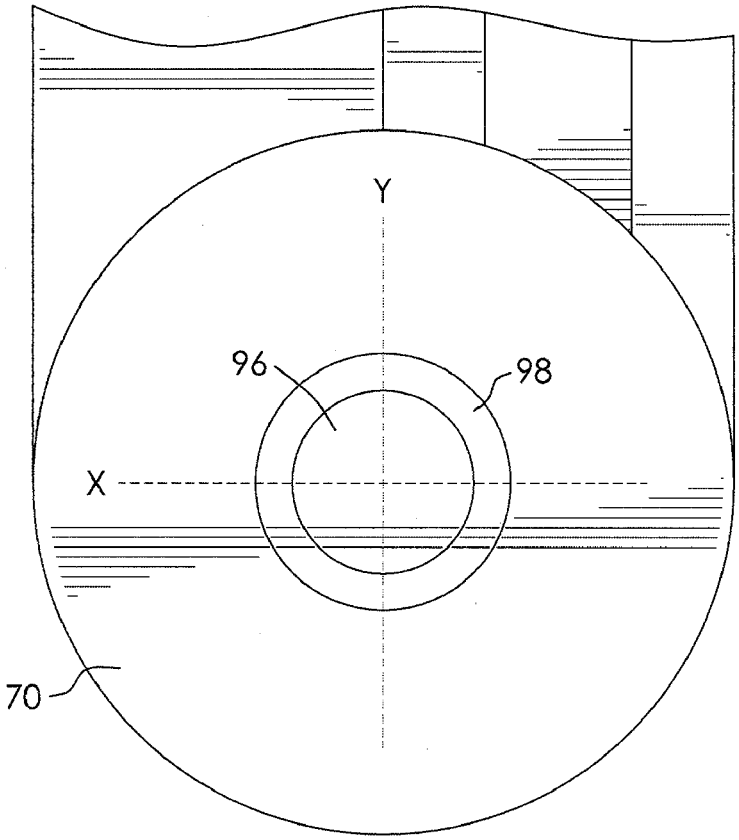
FIG. 9 is a fragmentary, plan view of the clamp of FIG. 5 showing a hinge and a pivot pin thereof.

The hinge 70 of the clamp 60 is best shown in FIG. 7 and includes a clevis 94 at the first end 66 of the first jaw member 62. The clevis 94 receives the second end 68 of the second jaw member 64. There is a clevis pin 96 which extends through the second jaw member 64 and the second jaw member 64 is pivotable about the clevis pin 96 which functions as a pivot pin for the second jaw member 64, i.e. the clevis 94 and the clevis pin 96 function as the hinge. The pivot or clevis pin 96 is provided with an elastomeric bearing in the form of O-rings 98 and 100 which are best shown in FIG. 8. The O-rings 98 and 100 allow for lateral movement of the pivot or clevis pin 96, for example along the X and Y axes as shown in FIG. 9. This lateral movement of the pivot or clevis pin 96 facilitates the clamping of bags of varying thicknesses. In other examples, the hinge may be in the form of an interleaved wheel.

Figure 11:
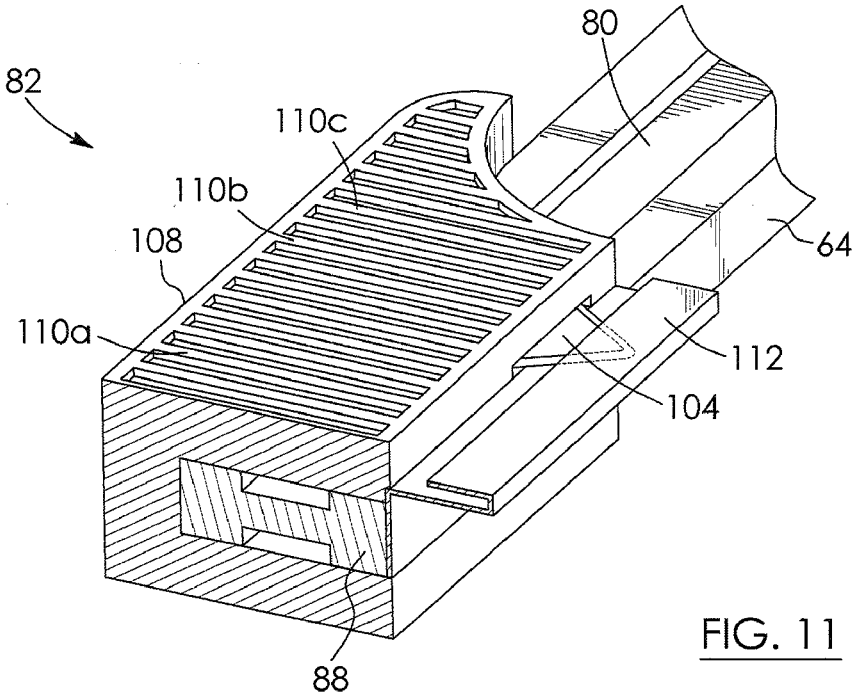
FIG. 11 is a fragmentary, perspective view of the clamp of FIG. 5 showing the cutting mechanism and a blade guard thereof.

The cutting mechanism 82 which is best shown in FIGS. 10 and 11 includes a blade mount 102 which is, generally U-shaped in profile, and moveable along the track 80 on the second jaw member 64. A blade 104, which in this example is a V-shaped, bi-directional cutting blade, is pivotably mounted on the blade mount 102 as best shown in FIG. 10. The blade 104 is biased by a resilient member 106 which in this example is a coil spring. The resilient member 106 biases the blade to a position in which the blade extends generally perpendicular to the blade mount. The blade 104 is however able to pivot in the direction generally indicated by arrows 270. This may prevent the cutting mechanism 82 from jamming as the blade 104 may pivot out of the way if it is unable to cut through a section of bag. The cutting mechanism 82 also includes a blade cover 108 which covers the blade mount 102 and resilient member 106. In this example, the blade cover 108 is provided with a plurality of ridges, for example ridges 110*a*, 110*b* and 110*c*, which may facilitate gripping of the blade cover 108 and thereby operation of the cutting mechanism 82. There is also a blade guard 112, which is U-shaped in profile, at the second end 88 of the second jaw member 64.

Figure 12:
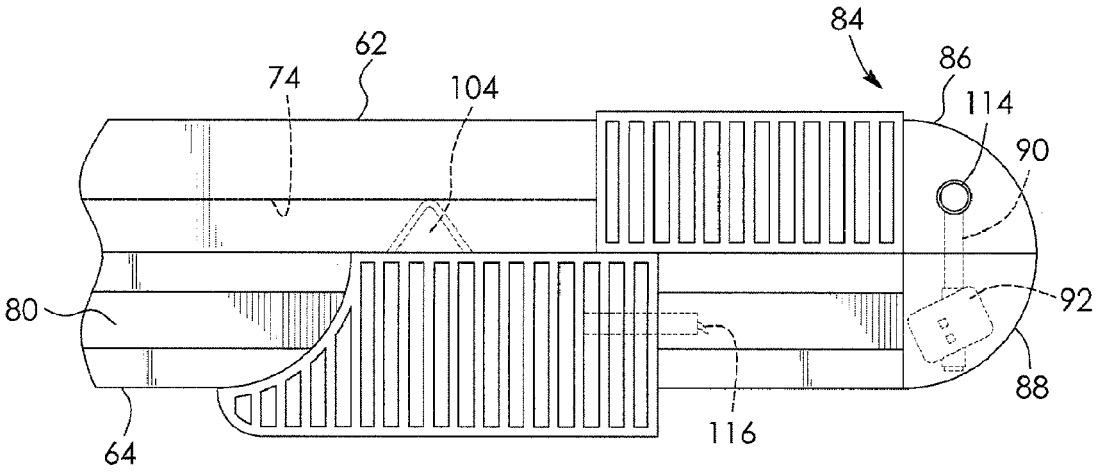
FIG. 12 is a fragmentary, plan view of the clamp of FIG. 5 showing the clamp in a closed configuration with a locking mechanism thereof in an engaged position.
Figure 13:
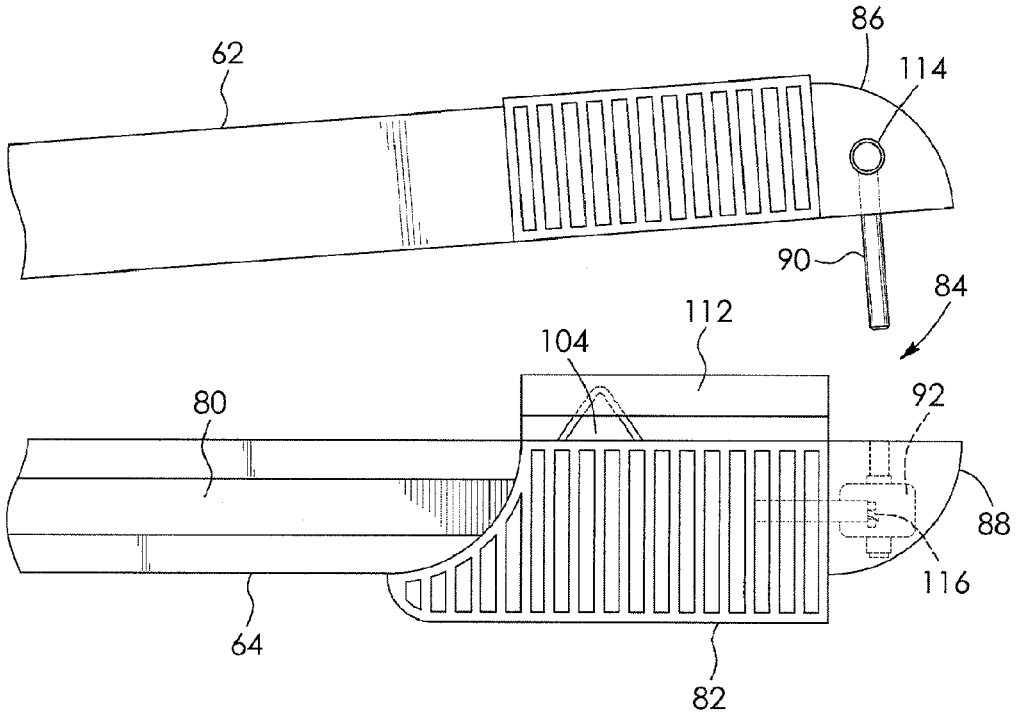
FIG. 13 is a fragmentary, plan view of the clamp of FIG. 5 showing the clamp in an open configuration with a locking mechanism thereof in an released position.

The locking mechanism 84 which releasably connects the jaw members 62 and 64 at respective second ends 86 and 88 thereof is best shown in FIGS. 12 and 13. In this example, the locking mechanism 84 is a ratcheted graduated locking mechanism and includes the ratchet pin 90 on the first jaw member 62 which may incrementally engage the graduated ratcheting clasp 92 in the second jaw member 64. The locking mechanism 84 also includes release button 114 which disengages the ratchet pin 90. When the clamp 60 is moved to the closed configuration, as shown in FIG. 12, the graduated ratcheting clasp 92 engages the ratchet pin 90 on the first jaw member 62 and locks the jaws members 62 and 64 together. Simultaneously the graduated ratcheting clasp 92 releases a ratcheting pin 116 of the cutting mechanism 82. This allows the cutting mechanism 82 to reciprocate along the track 80 on the second jaw member 64. The clamp 60 cannot be moved from the closed configuration to the open configuration when the ratcheting pin 116 of the cutting mechanism 82 is released from the graduated ratcheting clasp 92. The ratcheting pin 116 of the cutting mechanism 82 must be engaged with the graduated ratcheting clasp 92 for the graduated ratcheting mechanism to release the ratchet pin 90 on the first jaw member 62 and for the clamp 60 to be moved from the closed configuration to the open configuration. As best shown in FIG. 13, the blade 104 is docked in a blade guard 112 when the ratcheting pin 116 of the cutting mechanism 82 is engaged with the graduated ratcheting clasp 92. The blade 104 is accordingly not exposed when the clamp 60 is in the open configuration.

Figure 14:
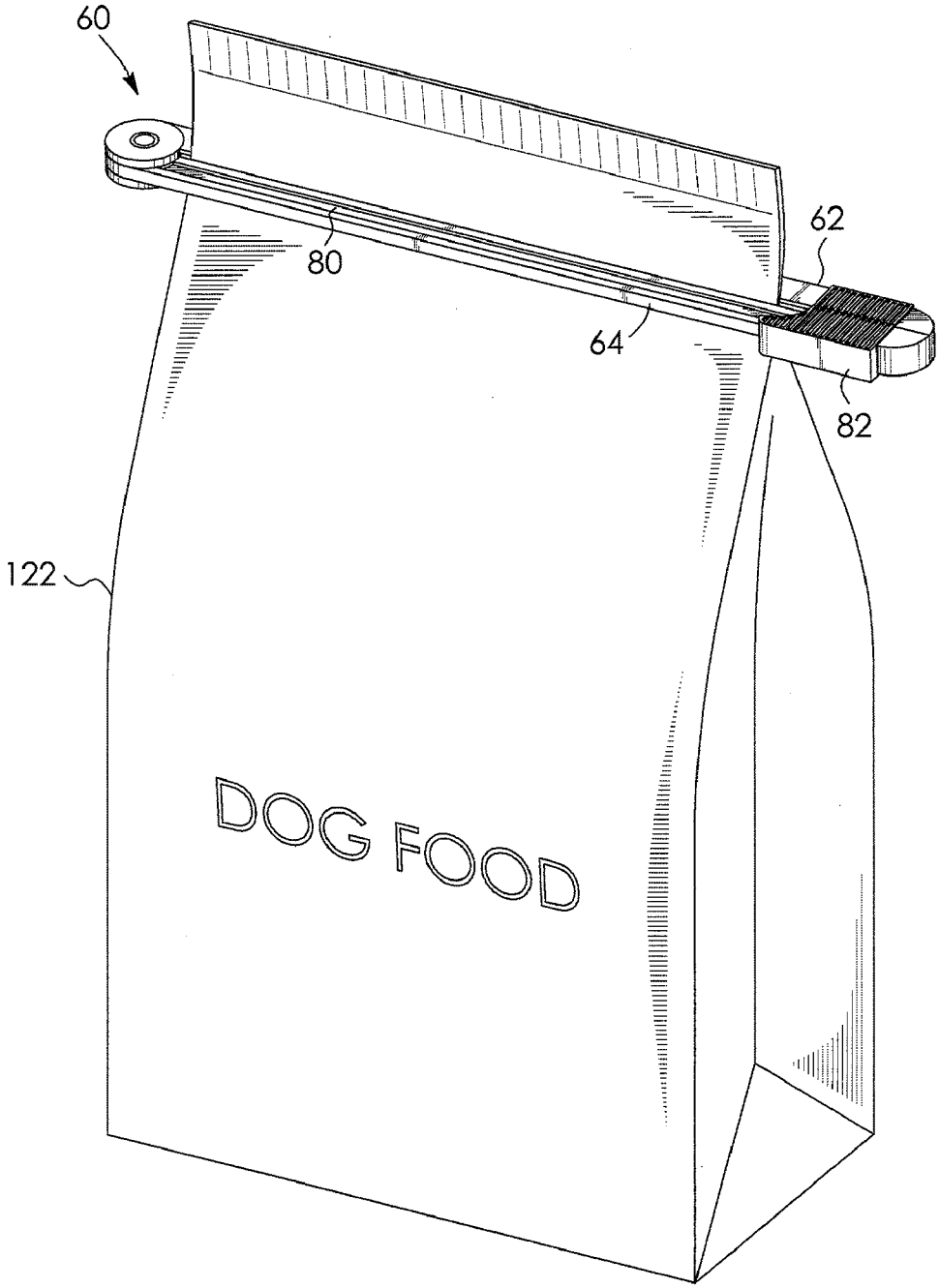
FIG. 14 is a perspective view of the clamp of FIG. 5 showing the clamp in a closed configuration and in engagement with a sealed bag.
Figure 15:
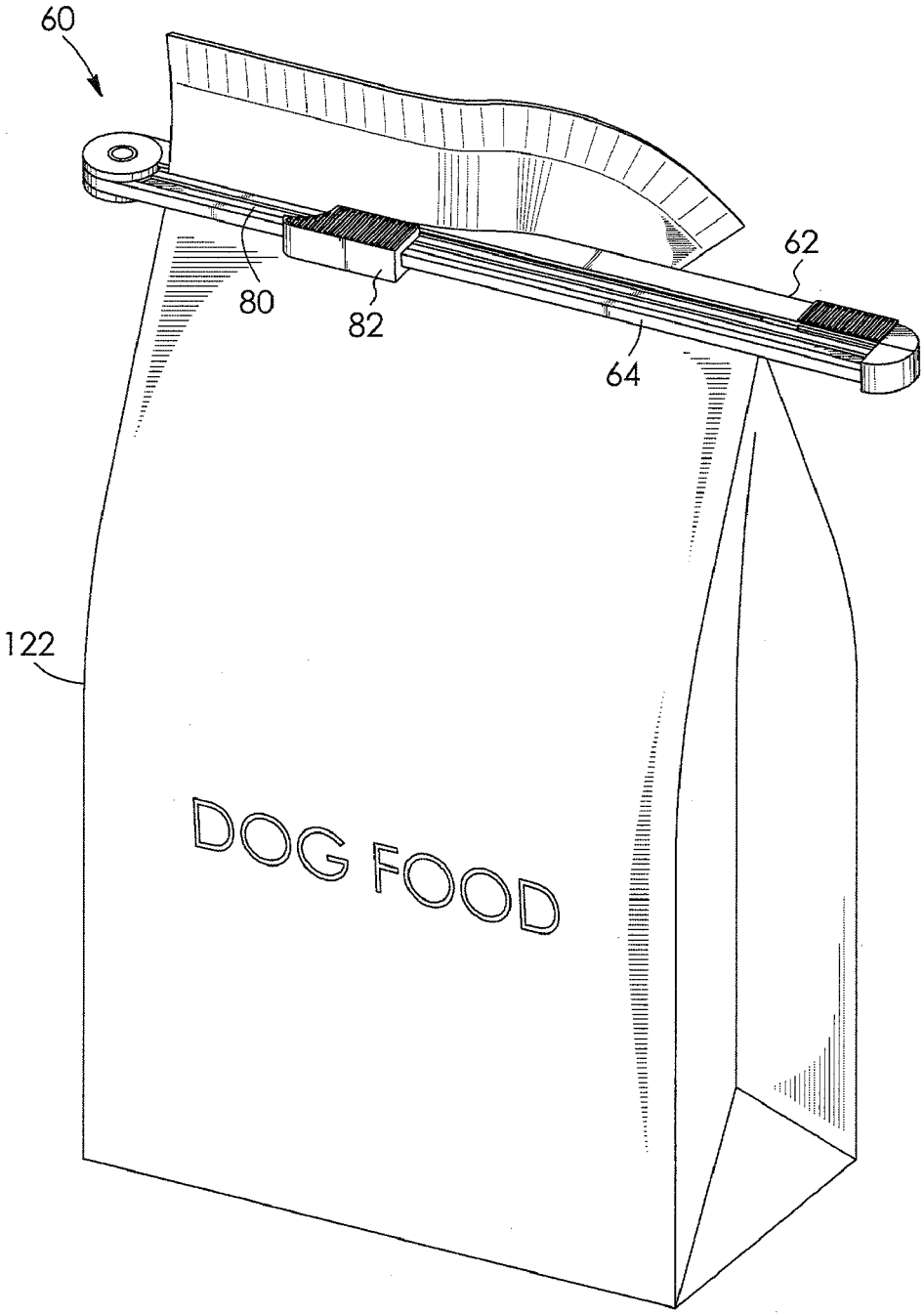
FIG. 15 is a perspective view of the clamp of FIG. 5 showing the clamp in a closed configuration and being used to open the sealed bag.

FIGS. 14 and 15 show the clamp 60 being used to open a sealed bag 122. The clamp 60 is first clamped to the bag 122 by engaging the ratchet pin 90 on the first jaw member 62 and the graduated ratcheting clasp 92 in the second jaw member 64 as shown in FIG. 12. This causes the graduated ratcheting clasp 92 to release the ratcheting pin 116 of the cutting mechanism 82. The cutting mechanism 82 is then reciprocated along the track 80 on the second jaw member 64 to cut the sealed bag 122 open as best shown in FIG. 15. As best shown in FIG. 10, the blade 104 of the cutting mechanism 82 extends through the opening 74 in the first jaw member 62 as the cutting mechanism 82 reciprocates along the track 80 on the second jaw member 64. The blade 104 is accordingly not exposed when the sealed bag 122 is being opened.

Figure 16:
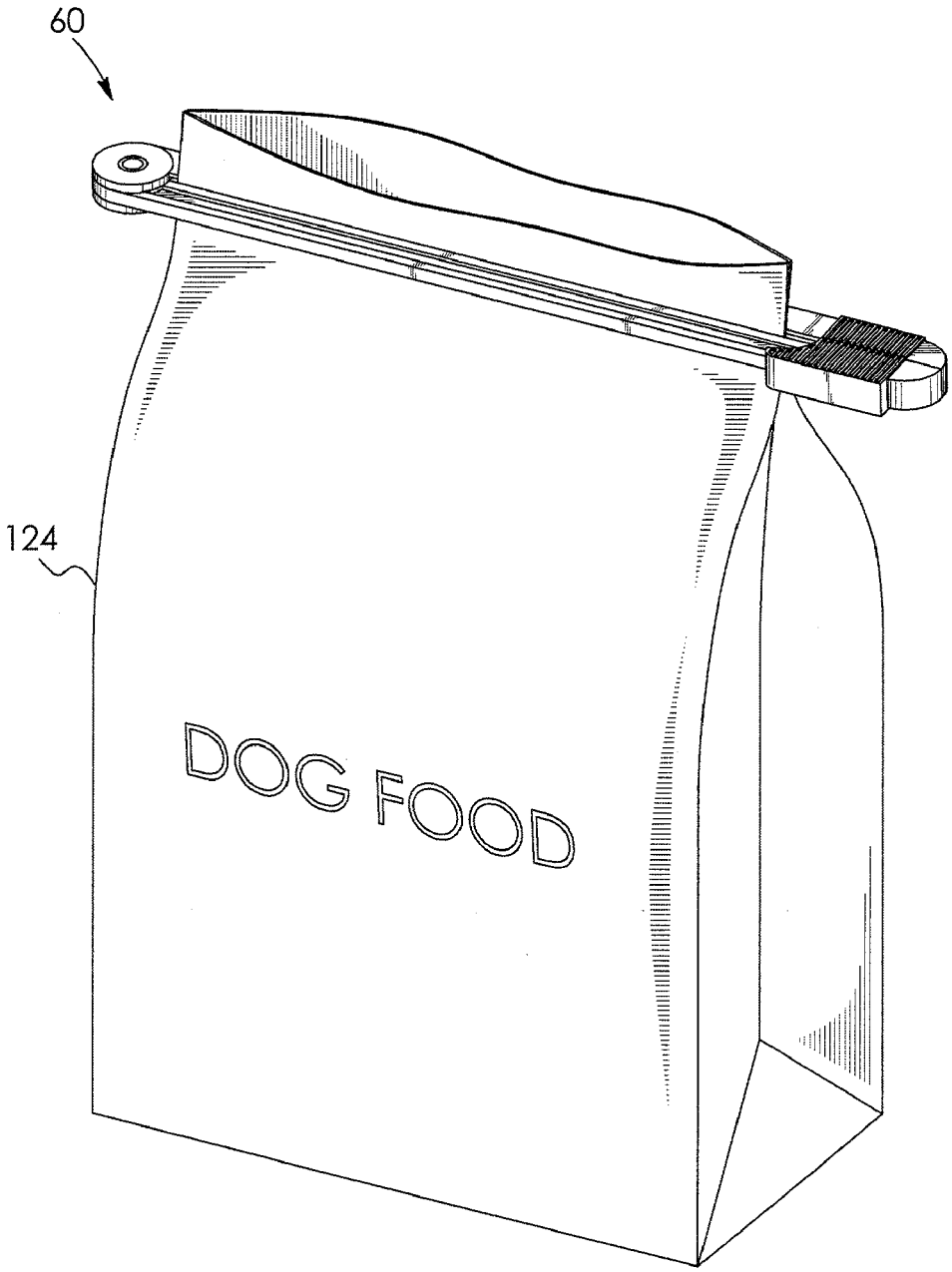
FIG. 16 is a perspective view of the clamp of FIG. 5 showing the clamp in a closed configuration and being used to releasably seal or close an open-mouthed bag.

Referring now to FIG. 16, when the clamp 60 is being used to seal an open-mouthed bag 124, the locking mechanism 84 is engaged by bringing the ratchet pin 90 on the first jaw member 62 in to engagement with the graduated ratcheting clasp 92 in the second jaw member 64 as shown in FIG. 12. The clamp 60 is thereby maintained in a closed configuration and is clamped to the open-mouthed bag 124 in a manner such that a portion of the bag is compressed between respective planar clamping surfaces of the jaw members 62 and 64 and the bag is effectively sealed. The locking mechanism 84 may however be released, and the jaw members 62 and 64 moved away from one another, to move the clamp 60 to an open configuration in which the jaws 62 and 64 are angularly spaced-apart. This allows access to the open-mouthed bag 124 which may later be resealed, i.e. the clamp 60 may be used to releasably seal the bag.

It will be understood by a person skilled in the art that the term "seal" as used herein has a broad definition and means general occlusion between the interior of the bag and the external environment.

It will also be understood by a person skilled in the art that many of the details provided above are by way of example only, and are not intended to limit the scope of the invention which is to be determined with reference to the following claims.

What is claimed is:

1. A bag clamp comprising:

a first jaw member and an opening in a clamping surface of the first jaw member;

a second jaw member and a pivotable bi-directional cutting blade reciprocatingly movable along the second jaw member;

a hinge coupling the first jaw member and the second jaw member, wherein the clamp is moveable between an open configuration in which the first jaw member and the second jaw member are angularly spaced-apart and a closed configuration in which the blade is received by the opening in the first jaw member and the blade is moveable along the second jaw member; and a releasable locking mechanism for locking the clamp in the closed configuration.

2. The bag clamp as claimed in claim 1 wherein the first jaw member is an elongate jaw member and the opening extends along a length of the first jaw member.

3. The bag clamp as claimed in claim 1 wherein the second jaw member is an elongate jaw member and the blade reciprocates along a length of the second jaw member.

4. The bag clamp as claimed in claim 1 wherein the hinge includes a pivot pin provided with an elastomeric bearing.

* * * * *